US007257319B1

(12) United States Patent
Clarke

(10) Patent No.: US 7,257,319 B1
(45) Date of Patent: Aug. 14, 2007

(54) JEWELRY CLEANING DEVICE

(76) Inventor: Michael E. Clarke, 2729 Woodson Dr., McKinney, TX (US) 75070

( * ) Notice: Subject to any disclaimer, the term of this patent is extended or adjusted under 35 U.S.C. 154(b) by 0 days.

(21) Appl. No.: 10/758,341

(22) Filed: Jan. 15, 2004

(51) Int. Cl.
*F17C 7/04* (2006.01)
*B08B 3/00* (2006.01)

(52) U.S. Cl. ..... 392/405; 134/102.1

(58) Field of Classification Search ..... 392/386, 392/387, 394, 396, 397, 398, 403, 404, 405, 392/406; 134/102.1, 102.2
See application file for complete search history.

(56) References Cited

U.S. PATENT DOCUMENTS

| | | | | |
|---|---|---|---|---|
| 377,228 | A | 1/1888 | Bartlett | |
| 965,724 | A | 7/1910 | Moneuse | |
| 1,587,950 | A | 6/1926 | Hare | |
| 1,835,283 | A | 12/1931 | Crickmer | |
| 1,878,560 | A | 9/1932 | Wier | |
| 2,624,618 | A | 1/1953 | Gelles et al. | |
| 2,753,212 | A | 7/1956 | Autlman | |
| 2,861,838 | A | 11/1958 | Wyatt et al. | |
| 3,039,454 | A | 6/1962 | Gilbertson et al. | |
| 3,119,004 | A | 1/1964 | Hoop | |
| 3,135,987 | A | 6/1964 | Huch | |
| 3,348,468 | A | 10/1967 | Eisendrath | |
| 3,675,449 | A | 7/1972 | Bluestein | |
| 4,114,194 | A | 9/1978 | Walter | |
| 4,204,465 | A | 5/1980 | Knecht | |
| 4,402,257 | A | 9/1983 | Marotta | |
| D271,145 | S | 10/1983 | McNaughton | |
| 4,414,037 | A | 11/1983 | Friedheim | |
| 4,632,024 | A | 12/1986 | Cortese | |
| 4,761,850 | A * | 8/1988 | Romeo et al. | 15/323 |
| 4,792,174 | A * | 12/1988 | Shioda | 296/37.12 |
| 4,870,982 | A | 10/1989 | Liu | |
| 4,941,490 | A | 7/1990 | Gross | |
| 4,949,738 | A | 8/1990 | Hubbard | |
| 5,017,759 | A | 5/1991 | Baldacci | |
| 5,042,954 | A | 8/1991 | Banks | |
| 5,209,784 | A | 5/1993 | Bellman | |
| 5,534,741 | A | 7/1996 | Smith | |
| 5,988,190 | A | 11/1999 | Borges | |
| 6,129,097 | A | 10/2000 | Papandrea | |
| 6,293,187 | B1 | 9/2001 | Zils | |
| 6,550,862 | B2 * | 4/2003 | Kain | 297/250.1 |
| D474,565 | S | 5/2003 | Pinchuk et al. | |

* cited by examiner

*Primary Examiner*—Sang Paik

(57) ABSTRACT

A jewelry cleaning device which emits a jet of steam under manually operable control means for the cleansing of various types of small items including jewelry, coins, trinkets, or the like. The jewelry cleaning device of the present invention is lightweight and relatively compact in size thus enabling its use on virtually any conventional tabletop and is easily stored when not in use. The steam generator is powered by conventional electrical power and is controlled by means of a thermostat to maintain the water/steam mixture at a predetermined temperature while in operation. Safety mechanisms include a pressure relief valve to automatically expel steam from the generator when the internal pressure thereof exceeds a predetermined level and a thermal fuse configured in a series connection with the heating element of the steam generator. A containment device is optionally provided which is made of screen mesh and fashioned into a cup-like shape, is slidably engaged onto the sidewall of the jewelry cleaning device housing and is disposed underneath the spout in such a manner to trap gems or other small parts which are inadvertently dislodged from the jewelry piece during the cleaning operation.

18 Claims, 4 Drawing Sheets

JEWELRY CLEANING DEVICE

CROSS-REFERENCE TO RELATED APPLICATIONS

Not Applicable.

FIELD OF THE INVENTION

This invention relates to steam cleaning devices, and more particularly, to a jewelry cleaning device utilizing a jet of steam which is suitable for personal use.

BACKGROUND OF THE INVENTION

Rings, bracelets, necklaces, watches, gems, earrings, and the like present a collection of various types of jewelry which many people today own and wear due to their aesthetically pleasing appearance. Nevertheless through daily wear, this jewelry can become dirty and tarnished thus diminishing their sightly appearance. Therefore, these items must be periodically cleaned in order to maintain their original beauty. Liquid jewelry cleaning formulations which have been developed for this purpose have enjoyed limited success, due mainly to the fact that several common forms of dirt and grime are unaffected thereby. Steam cleaning devices on the other hand have been known for a long time as a valid means of thoroughly cleaning most forms and dirt and grime from jewelry pieces; however, the use of these steam cleaning devices for jewelry items have largely been relegated to jewelry stores and other similar commercial establishments due to their rather large size and complicated design.

A number of steam cleaning devices have been developed which disclose a means of cleaning jewelry via a relatively high velocity stream of water vapor or steam and examples of such devices includes U.S. Pat. No. 2,753,212 to Aultman, and U.S. Pat. No. 4,414,037 to Friedheim. In addition, U.S. Pat. No. 4,941,490 to Gross discloses a jewelry cleaning means utilizing a high velocity stream of air mixed with a relatively low temperature cleaning solution. Although all of these devices provide an effective method of cleaning jewelry, they suffer in that they are of complex design thus rendering them cost-prohibitive for personal use. Moreover, these complex designs which have been relegated to commercial use have further compounded the problem of complexity in that more stringent safety mechanisms are necessary due to their operation in a commercial environment, thereby further raising their costs. This is due in part to the fact that their use in a commercial environment has necessitated relatively large sized mechanisms which are able to handle high levels of usage.

Auxiliary mechanisms for steam cleaning devices that have been developed to provide a containment structure for jewelry items being cleaned include U.S. Pat. No. 4,949,738 to Hubbard and U.S. Pat. No. 6,129,097 to Papandrea. Each of these devices discloses a means of insuring that small gems which are inadvertently dislodged from the jewelry piece remain within a containment structure during the cleaning process. Similarly to the large steam cleaning devices to which they are attached, these devices are large bulky items and thus generally unsuitable for personal use.

Thus, there has been a long-felt need for a jewelry cleaning device which is sufficiently small and simple in design to enable its use in a residential environment. Moreover, the device's simple, non-complex construction should thus be inexpensive to produce as well as easy to maintain thereby enabling the personal use thereof.

SUMMARY OF THE INVENTION AND OBJECTIVES

The present invention provides a solution to these as well as other needs via a jewelry cleaning device which is small and inexpensive to produce thereby allowing its usage in a residential environment. The device generally comprises a steam generator in fluid communication with a spout which emits a high velocity jet of steam under manually operable control means whereby jewelry items may be effectively cleaned thereby. The jewelry cleaning device of the present invention is lightweight and relatively compact in size thus enabling its use on virtually any tabletop and is easily stored when not in use. The steam generator is commensurately small in size thus minimizing the severity of any safety hazard produced via any of the potential failure modes thereof. The steam generator is powered by conventional electrical power and is controlled by means of a thermostat to maintain the water/steam mixture at a predetermined temperature while in operation. Safety mechanisms include a pressure relief valve to automatically expel steam from the generator when the internal pressure thereof exceeds a predetermined level and a thermal fuse configured in a series connection with the heating element of the steam generator.

Optionally, a containment device is provided in order to trap gems or other small parts which are inadvertently dislodged from the jewelry piece during the cleaning operation. The containment device, which is made of screen mesh and fashioned into a cup-like shape, is slidably engaged onto the sidewall of the jewelry cleaning device and is disposed underneath the spout in such a manner that the entire jet of steam passes therethrough. The mesh of the screen is sufficiently fine to trap any sized gem on its upper surface yet allows the steam stream to easily pass therethrough.

One aspect of the present invention contemplates a jewelry device that is inexpensive to produce and maintain. The present invention utilizes a steam generation means having a design that has been approved for use in residential environments by unskilled operators though the supervisory safety regulatory agencies, yet heretofore has not been known to the art of jewelry cleaning. The present invention's design also differs from the prior known steam cleaning devices for jewelry in that the supervisory regulatory agencies do not require periodic maintenance or inspection thereof, thus further reducing costs. In addition, the relatively small size and lightweight design provides for inexpensive materials costs as well as inexpensive shipping and handling costs.

Another aspect of the present invention is a jewelry cleaning device that is easy to use. The jewelry cleaning device has relatively few moving parts and requires no adjustment mechanisms, thereby allowing use by an unskilled user. The temperature within the steam generator is automatically controlled in order to maintain a constant pressure thereby obviating the need for user adjustment, whereby a consistent spray pattern is always available to the user upon demand. In addition, the present invention exists as a compact space-efficient package, not having any bulky elongated flexible hoses or other cable control structures attached thereto. This compact design also provides for easy storage of the device when not in use.

It is therefore an object of the present invention to provide a jewelry cleaning device which is relatively inexpensive to produce as well as to maintain, thereby enabling the personal use thereof.

A further object of the present invention is to provide a jewelry cleaning device utilizing a pressurized steam generation means to deliver a relatively high velocity jet of steam requiring no external adjustment mechanisms in order to enable its use by an unskilled user.

A related object of the present invention is to provide a jewelry cleaning device which is relatively compact in size thereby allowing the easy storage thereof when not in use.

Another object of the present invention is to provide a jewelry cleaning device having a gem containment means for the trapping of small gems which become dislodged from the jewelry piece during the cleaning operation that is relatively small and lightweight and is releasably attachable thereto.

These and other objects of the present invention will become readily apparent to those familiar with the construction and use of steam cleaning devices and will become apparent in the following portions of the specification, wherein the detailed description is for the purpose of fully disclosing preferred embodiments of the invention without placing limitations thereon.

BRIEF DESCRIPTION OF THE DRAWINGS

For a more complete understanding of the present invention, and the advantages thereof, reference is now made to the following descriptions taken in conjunction with the accompanying drawings in which.

DETAILED DESCRIPTION OF THE PREFERRED EMBODIMENTS

Figure 1:
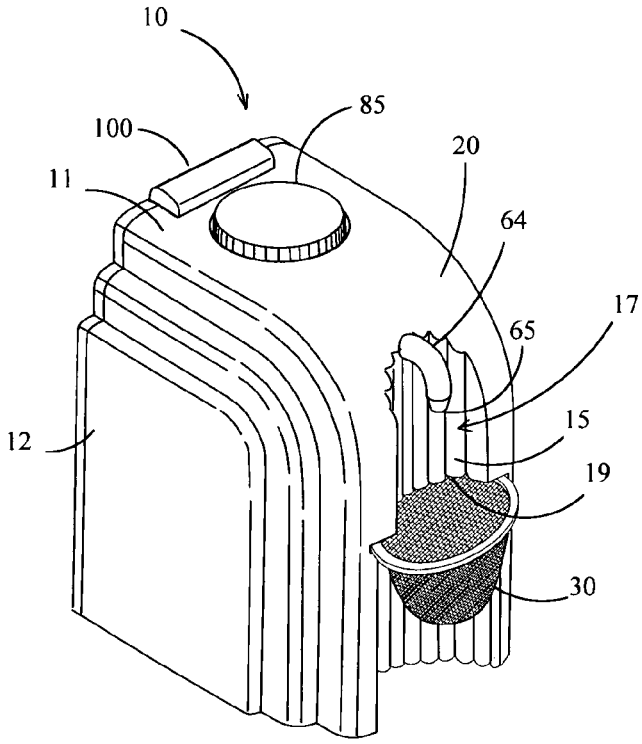
FIG. 1 is a perspective view of a preferred embodiment of the present invention showing the entire device as a self-contained unit suitable for use on a conventional tabletop.

As shown in FIGS. 1 through 4, a jewelry cleaning device embodying a preferred embodiment of the instant invention is designated generally by reference numeral 10. The jewelry cleaning device is generally shown having a housing for enclosing a steam generator (to be described later), a pressure safety cap 85, a valve actuator button 100, and a steam tube 64 for directing a jet of steam downwards through a removable catch basket 30. The steam tube 64 has a terminating end 65 which is constricted in order to emit the steam at a relatively high velocity. The valve actuator button 100 is selectively operable by a user to cause a momentary burst of steam to emanate from the terminating end 65 of the steam tube 64. The space directly below the terminating end 65 of the steam tube 64 which includes the relatively high velocity jet of steam that is above the catch basket 30 defines a cleaning zone 17 whereby jewelry or other small items may be cleaned thereby. The catch basket is provided to trap small gems which may inadvertently become dislodged during the cleaning operation.

Figure 5:
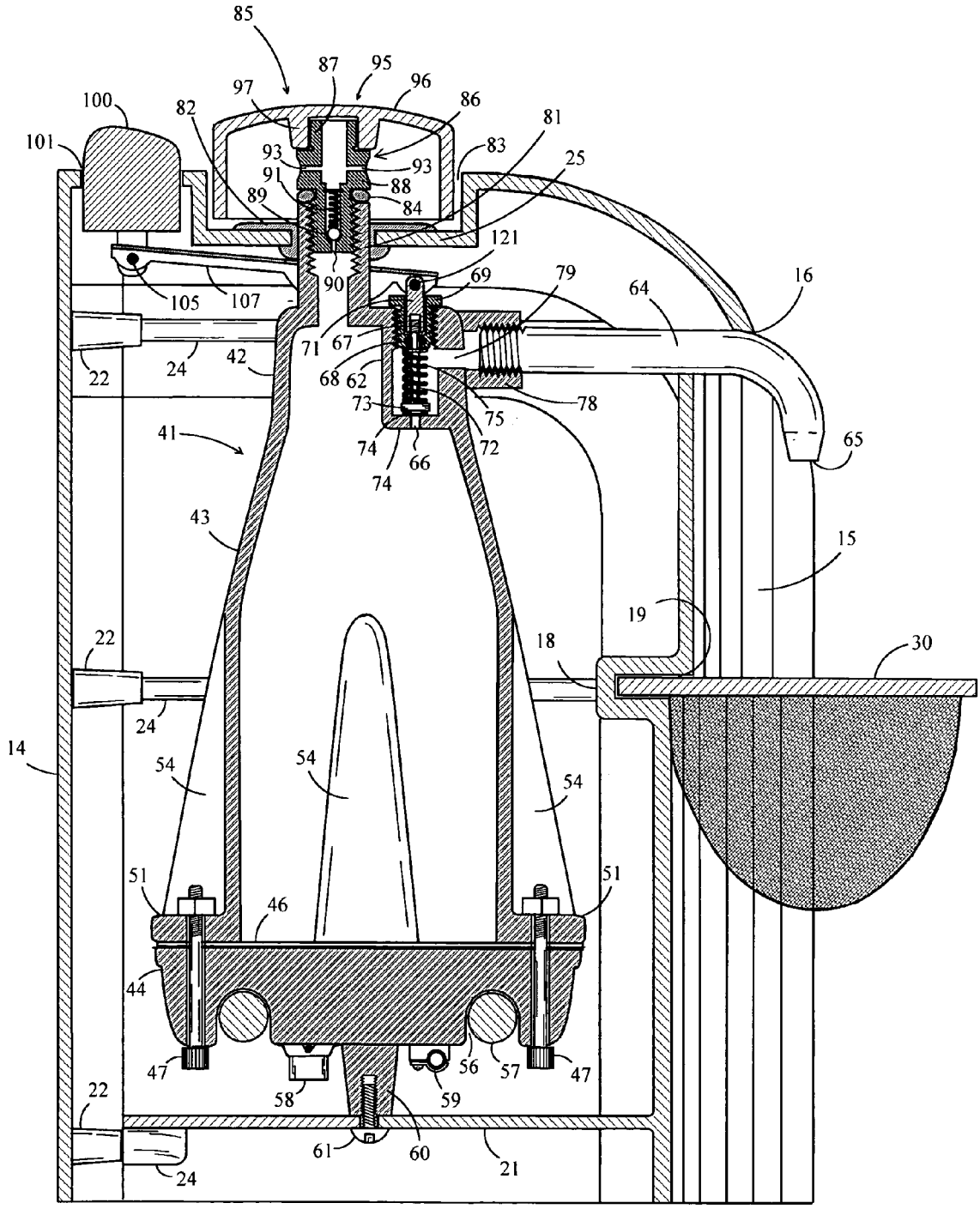
FIG. 5 is an elevational cross-sectional view of the embodiment of FIG. 2 taken at 5—5.

The housing shown generally comprises an upper wall 11, and left 12, right 13, rear 14, front 15, and bottom 21 sidewalls made of any thermoplastic material, preferably polypropylene. The front sidewall 15 is generally concave in shape having an aperture 16 proximate the upper wall 11 thereof for receipt of the steam tube 64 therethrough. The front sidewall 15 is generally concave in shape in order to conform to the lateral space defined by the cleaning zone and to minimize the lateral distance which the steam tube must protrude beyond the front sidewall. The front sidewall 15 also has a catch basket retaining member 18 which extends laterally across the front wall 15 having a slot 19 formed therein to slidably receive the rim 32 of the catch basket 30. The front edge of the upper wall 11 is integrally attached to the front sidewall 15 to define an adjoining edge 20 which is chamfered in order to create an aesthetically pleasing finish. In addition, the aesthetic appeal of the housing is further enhanced by the multi-tiered contour of the left 12 and right 13 sidewalls. The rear sidewall sidewall 14 is selectively removable in order to provide access to the contents of the housing. The rear sidewall 14 is removably attached via screws 23 which are inserted through cup-shaped depressions 22 in the rear sidewall 14 and anchored to pedestals 24 which are integrally attached to the left 12 and right 13 sidewalls as best shown in FIG. 5. The jewelry cleaning device 10 of the present invention also includes an elongated depression 26 disposed in the rear sidewall 14 for placement of tongs 27 therein. The tongs 27 provide a means of holding the jewelry piece during the cleaning operation. The width of the depression 26 is chosen such that the tongs 27 are removably held therein with a snug fit. A finger access depression 28 is included which is adjoined to the elongated depression 26 in order to allow easy access to the tongs 27 by a user.

Figure 2:
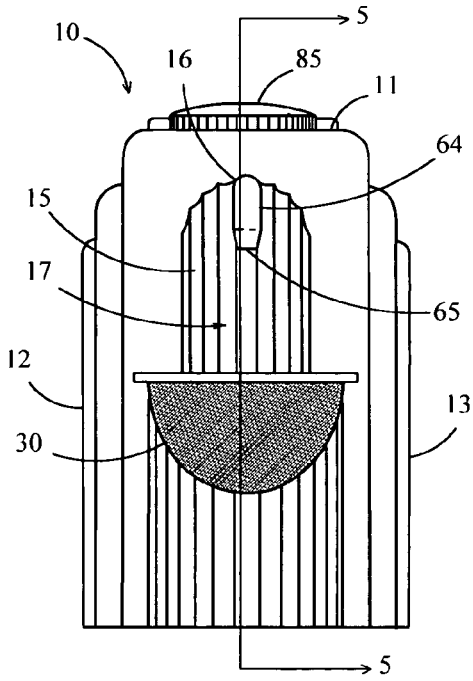
FIG. 2 is a front elevational view of the embodiment of FIG. 1.
Figure 3:
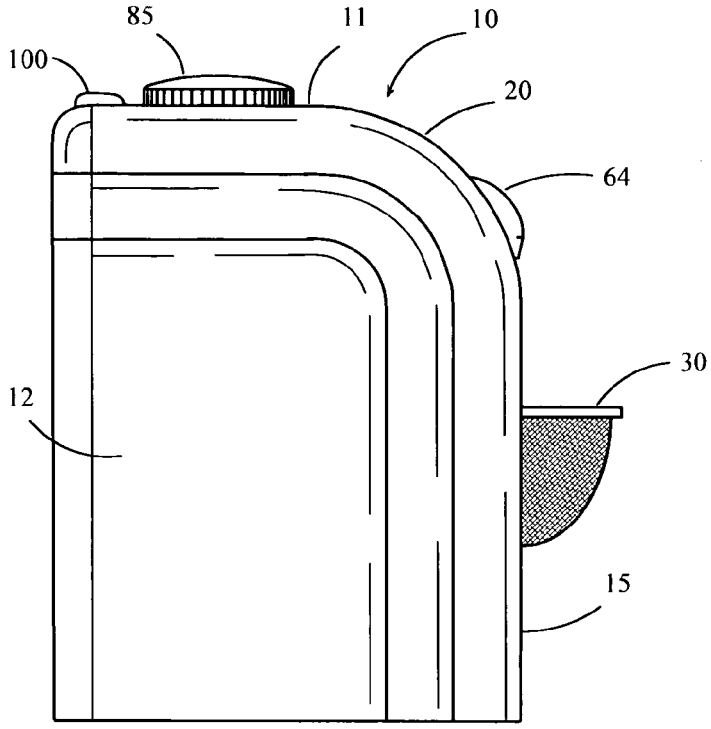
FIG. 3 is a side elevational view of the embodiment of FIG. 1.
Figure 4:
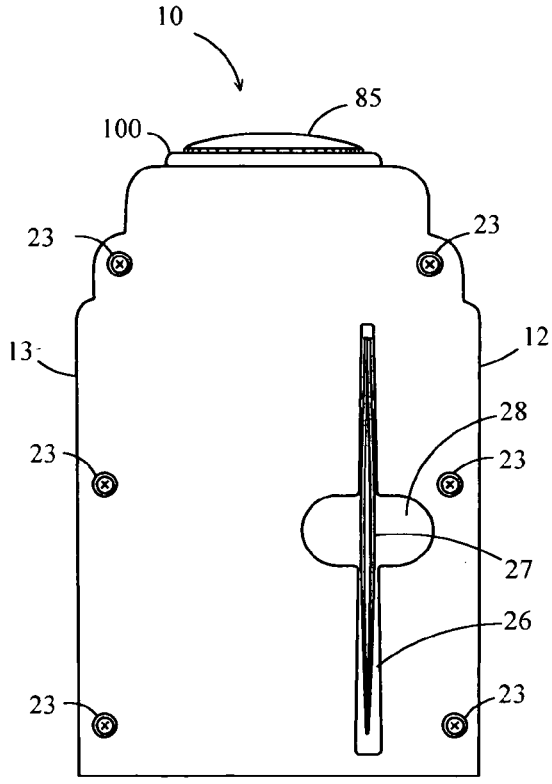
FIG. 4 is a rear elevational view of the embodiment of FIG. 1 showing a vertically oriented, elongated depression in the rear sidewall into which tongs are releasably disposed.
Figure 6:
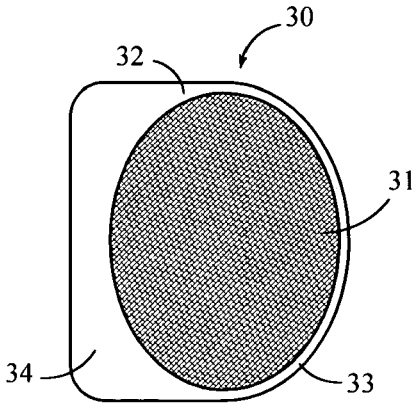
FIG. 6 is a plan view of the slidably removable catch basket of the embodiment of FIG. 1.
Figure 7:
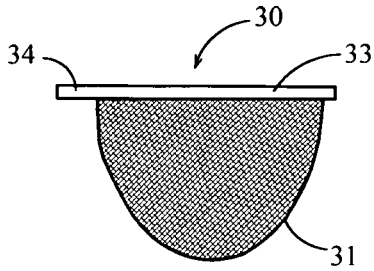
FIG. 7 is a side elevational view of the slidably removable catch basket of FIG. 6.

The catch basket 30 which is shown in greater detail in FIGS. 6 and 7, has a screen member 31 formed into a hemi-ellipsoid shape whose upper edge is attached to a rim 32. The rim 32 comprises an annular ring portion 33 which extends around the entire circumference of the screen 31 and a lip portion 34 which is integrally attached to the ring portion 33 for slidable insertion into the slot 18. FIGS. 1 through 3 show the catch basket in the inserted position, however, the user may optionally remove the catch basket from the housing by pulling the catch basket 30 away from the housing, thereby enabling the cleaning of larger items or for the efficient storage thereof.

As shown in FIG. 5, the steam generator includes a canister portion 41 made of any metal, preferably aluminum, which has a maximum water holding capacity of up to approximately 16 ounces of fluid, and most preferably about 8 ounces of fluid. The canister portion 41 has a cup-shaped neck member 42 which is integrally attached to a generally frusto-conical shaped body member 43, and a bottom member 44 which is removably attached to body member 43 with a heat resistant gasket 46 sandwiched therebetween to form a pressure tight chamber for the heated steam/water mixture. Removable attachment of the bottom member 44 to the body member 43 is provided by bolts 47 which extend through apertures formed in the bottom member 44 as well as apertures formed in flanges 51 which are integrally attached to body member 43. Conical shaped depressions 54 in the walls of the body member 43 allow access to the associated nuts of the bolts 47. A pedestal 60 is provided for support of the canister 41 within the housing. The pedestal 60 is integrally attached to the bottom member 44 and extends downward therefrom to the bottom sidewall 21 and is secured thereto with bolt 61.

The bottom member 44 has an annular slot 56 for housing a ring-shaped heater element 57 therein. The heater element 57 is preferably an 800 watt calrod device. The bottom member 44 also has a thermostat 58 mounted thereto which is electrically connected to the heater element 57 via a series connection which turns on power to the heater element when the canister temperature drops below a first predetermined threshold and turn off power when the temperature goes above a second predetermined threshold. To prevent thermal runaway of the canister temperature due to a failure of the thermostat, a thermal fuse 59 which is mounted to the bottom member 44 and thus in thermal communication thereto is also configured in a series connection with the heater element 57 to create an electrically open circuit if the temperature of the canister goes above a predetermined temperature, preferably about 450 degrees Fahrenheit. The heater element 57, thermostat 58, and thermal fuse 59 define an electrical circuit which terminates in an electrical cord (not shown) for connection to a suitable source of electrical power.

The neck member 42 has a valve body 62 integrally formed therein to provide for selective communication of the steam from the canister to the steam tube 64. The valve body 62 has an aperture 66 disposed at its lower end in order to provide fluid communication from the canister 41 into the valve body 62. Steam flow through the aperture 66 is regulated by a valve pin assembly which is slidably received in a hollow shaped plug 67 having an o-ring 68 disposed therebetween to prevent the leakage of steam therethrough. The upper end of the inner wall of the valve body 62 is threaded to threadably receive the plug 67 wherein the head 69 thereof is hexagonally shaped in order to facilitate insertion via a conventional wrench. The valve pin assembly generally includes a pin head 71 which is screwably connected to a connecting rod 72 having a seat flange 73 attached at its lower extremity. A thermally resistant valve seat 74 which is attached to the bottom surface of the seat flange 73 using any suitable adhesive is springably biased against the aperture 66 via compression spring 75. Thus, communication of the steam through the valve is inhibited when no external force is placed upon the pin head 71. Conversely, when a generally upward directing force acts on the pin head 71, the valve is opened and steam is allowed to flow freely from the canister to the steam tube 64. A tube-shaped projection 78 is integrally attached to the neck member 42 having an aperture 79 therebetween, wherein projection 78 has threads on its inner surface to threadably receive the steam tube 64 therein. The steam tube 64 is preferably made from a thermoplastic material such as polypropylene to minimize the amount of heat conduction to the outer perimeter thereof due to hot steam passing therethrough.

Integrally formed with the neck member 42 is a fill tube 81 which extends vertically thereabove. The fill tube 81 extends slightly above the bottom wall of a cup-shaped depression 25 and is held in place with a snug water-tight fit with a grommet 82 therebetween. The depression 25 is integrally attached to the upper wall 11 of the housing having a predetermined diameter to accommodate the bottom edge of the pressure safety cap 85 with an air gap 83 therebetween. The fill tube 81 has internal threads to threadably receive the external threads of the safety valve portion 86 of the pressure safety cap 85. The safety valve portion 86 generally comprises a cylindrical pressure relief housing 87 made preferably of brass, having a generally disk-shaped member 88 integrally attached thereto. An o-ring 84 which extends around the periphery of the housing 87 and abuts member 88 thereunder serves to prevent the leakage of steam past the housing 87. The bottom end of pressure relief housing has a seat having an aperture 90 therein for receipt of a small ball valve member 89 which is springably biased to the closed position. A compression spring 91 exerts a downward force on ball member such that when the internal pressure within the canister exceeds a predetermined pressure, preferably less than 15 psi, the steam may be vented therefrom. Vent holes 93 disposed in member 88 allow the steam within housing 87 to pass through to the ambient environment. The pressure safety cap 85 also comprises a shroud portion 95 for hand screwing of the valve portion to and from the fill tube 81. The shroud portion 95 comprises a generally inverted cup-shaped member 96 made of any material, preferably polypropylene, having an annular-shaped valve mount member 97 integrally attached thereto for securement of the safety valve portion 86 via a press fit.

Figure 8:
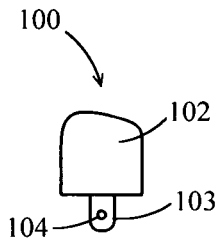
FIG. 8 is a side elevational view of the valve actuator button of the embodiment of FIG. 1.
Figure 9:
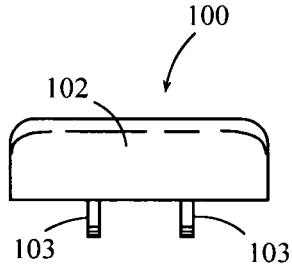
FIG. 9 is a front elevational view of the valve actuator button of FIG. 8.
Figure 10:
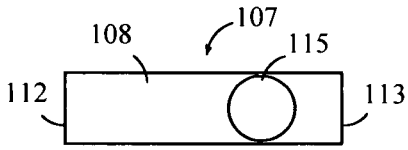
FIG. 10 is a plan view of the rocker arm of the embodiment of FIG. 1.
Figure 11:
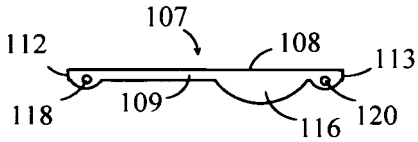
FIG. 11 is a side elevational view of the rocker arm of FIG. 10.
Figure 12:
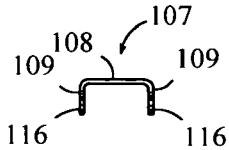
FIG. 12 is a front elevational view of the rocker arm of FIG. 10.

Manual control of the jet of steam is provided by a valve actuator button 100 disposed within a rectangular shaped hole 101 in the upper wall 11 proximate the rear edge thereof in conjunction with a rocker arm 107. The valve actuator button 100 constructed of any material, preferably plastic, comprises a body portion 102 having two arms 103 which depend downward from and are integrally attached thereto as best shown in FIGS. 8 and 9. Both of the arms 103 have holes 104 formed therein for receipt of a pintle bolt 105 therethrough. The rocker arm 107 acts to translate the vertically directing downward force of the button 100 to a generally upward directing force on the pin head 71 of the valve pin assembly via fulcrum member 116. The rocker arm 107 is comprised of a an elongated section of sheet metal having a generally inverted U-shaped cross-section defining top 108, and side walls 109 which terminate at proximal 112 and distal 113 ends. The top wall 108 has a circular shaped hole 115 formed therein through which the fill tube 81 extends. Two fulcrum members 116 depend from and are integrally attached to each of the side walls 109 which rest upon the surface of the neck member 42 thereby allowing the rocker arm 107 to pivot about its axis. Holes 118 exist in each side wall 109 proximate the proximal end 112 thereof for providing a rotatable connection to the arms 103 of button 100 via bolt 105. Similarly, holes 120 exist in each side wall 109 proximate the distal end 113 thereof for providing a rotatable connection the pin head 71 via bolt 121. Thus, when a downward force on the button 100 is applied by a user, the button consequently rotates the rocker arm 107 about fulcrum member 116 and lifts the valve pin assembly thereby opening the valve.

To use, the pressure safety cap 85 is temporarily unscrewed from the device 10 and a predetermined volume of water which is less than the maximum water holding capacity of the canister is poured into the canister 41 via the fill tube 81. It is to be understood that the maximum water holding capacity is slightly less than the absolute volumetric capacity of the canister so that the water level does not extend above the aperture 66 of the valve body 62. Next, the pressure safety cap 85 is screwed onto the fill tube 81 and the electrical cord connected to a suitable source of electrical power. As electrical power is applied to the heater element 57, the steam generated thereby raises the pressure within the canister to a level which is maintained in equilibrium by the thermostat 58. When equilibrium of the steam/water mixture has been achieved, the device 10 is ready to use. A jewelry piece is placed within the cleaning zone 17 using tongs 27 and the actuator button 100 pressed by a user thereby causing a jet of steam to be emitted from the tube 64 and enveloping the jewelry piece to be cleaned. Failure protection mechanisms include a pressure safety valve which automatically releases steam from the canister 41 if the internal pressure of the canister exceeds a predetermined level and a thermal fuse 59 which automatically opens the circuit to the heater element 57 if the temperature exceeds a predetermined level.

The present invention may be embodied in other specific forms without departing from the spirit or scope of the invention. For example, although the present disclosure described a means of cleaning jewelry, is well known in the art that other small items may be cleaned by immersion in the jet of steam such as coins, trinkets, or the like. Therefore, the described embodiments are to be considered in all respects only as illustrative and not restrictive. The scope of the invention is therefore, indicated by the appended claims rather than by the foregoing description. All changes which come within the meaning and range of equivalency of the claims are to be embraced within their scope.

I claim:

1. An apparatus for cleaning small items such as jewelry using a jet of steam, said device comprising:

a steam generator disposed within a housing means, said steam generator having a sealable canister for holding a heated water and steam mixture under pressure;

heating means to heat said sealable canister;

a manually operated valve which is attached to said sealable canister, wherein said manually operated valve provides selective communication of said steam from said sealable canister to;

a generally rigid steam tube which is attached to said manually operated valve for communicating said steam to the terminating end of said steam tube, said terminating end of said steam tube is oriented vertically such that said jet of steam is adapted to be projected generally downward in direction, said terminating end is adapted to emit said jet of steam to the ambient environment, whereby the space defined by said jet of steam defines a cleaning zone whereby small items such as jewelry may cleaned by immersion therein; and, a catch basket which is disposed on said housing means, said catch basket having a screen member which is disposed underneath said terminating end of said steam tube and oriented to laterally traverse said jet of steam to trap small gems which may inadvertently become dislodged by said jet of steam during the cleaning operation while simultaneously allowing said jet of steam to pass freely therethrough;

wherein said housing means comprises a front sidewall, said front sidewall having an aperture for receipt of said steam tube therethrough, said front sidewall being concave in shape in order to conform to the lateral space defined by said cleaning zone and to minimize the lateral distance which said steam tube projects beyond said front sidewall.

2. The apparatus of claim 1, wherein said heating means is automatically controlled by a thermostat, said thermostat is mounted to said sealable canister wherein said thermostat controls the pressure of said water and steam mixture within said sealable canister.

3. The apparatus of claim 1, wherein said manually operated valve is manually operable by a valve actuator button means disposed on said housing means, thereby obviating the need for remotely positioned manually operated valves requiring cumbersome cabling structures.

4. The apparatus of claim 1, wherein said steam tube is made of a thermoplastic material.

5. The apparatus of claim 1, wherein said sealable canister further comprises a pressure safety valve means for automatically releasing said steam in said sealable canister to ambient environment if the pressure in said sealable canister exceeds a predetermined level.

6. The apparatus of claim 5, wherein said predetermined level of pressure in sealable canister is less than 15 psi.

7. The apparatus of claim 1, wherein said sealable canister has a maximum water holding capacity of up to 16 ounces of fluid.

8. The apparatus of claim 1, wherein said catch basket further comprises slidable insertion means for removable attachment to said housing means.

9. The apparatus of claim 1, wherein said housing means further comprises tong holding means for the efficient and easily accessible storage of conventional tongs.

10. A method for cleaning small items such as jewelry using a jet of steam, said steps comprising:

providing a steam generator having a sealable canister for holding a heated water and steam mixture under pressure, heating means to heat said sealable canister, a manually operated valve which is attached to said sealable canister, wherein said manually operated valve provides selective communication of said steam from said sealable canister to a generally rigid steam tube which is attached to said manually operated valve for communicating said steam to the terminating end of said steam tube, said terminating end of said steam tube is oriented vertically such that said jet of steam is adapted to be projected generally downward in direction, said terminating end is adapted to emit said jet of steam to the ambient environment, whereby the space defined by said jet of steam defines a cleaning zone, wherein said housing means comprises a front sidewall, said front sidewall having an aperture for receipt of said steam tube therethrough, said front sidewall being concave in shape in order to conform to the lateral space defined by said cleaning zone and to minimize the lateral distance which said steam tube projects beyond said front sidewall;

connecting said heating means to a suitable source of electrical power;

actuating said manually operated valve thereby causing a jet of steam to be emitted from said terminating end of said steam tube; and, immersing said small item to be cleaned in said cleaning zone.

11. The method of claim 10, wherein said steam generator is disposed in a housing means, said housing means having a catch basket disposed thereon, said catch basket having a screen member which is disposed underneath said terminating end of said steam tube and oriented to laterally traverse said jet of steam to trap small gems which may inadvertently become dislodged by said jet of steam during the cleaning operation while simultaneously allowing said jet of steam to pass freely therethrough.

12. The method of claim 10, wherein said heating means is automatically controlled by a thermostat, said thermostat is mounted to said sealable canister wherein said thermostat controls the pressure of said water and steam mixture within said sealable canister.

13. The method of claim 10, wherein said manually operated valve is manually operable by a valve actuator button means disposed on said housing means, thereby obviating the need for remotely positioned manually operated valves requiring cumbersome cabling structures.

14. The method of claim 10, wherein said steam tube is made of a thermoplastic material.

15. The method of claim 10, wherein said sealable canister further comprises a pressure safety valve means for automatically releasing said steam in said sealable canister to ambient environment if the pressure in said sealable canister exceeds a predetermined level.

16. The method of claim 15, wherein said predetermined level of pressure in sealable canister is less than 15 psi.

17. The method of claim 10, wherein said sealable canister has a maximum water holding capacity of up to 16 ounces of fluid.

18. The method of claim 10, wherein said catch basket further comprises slidable insertion means for removable attachment to said housing means.

* * * * *